United States Patent [19]

Saito et al.

[11] Patent Number: 4,594,482

[45] Date of Patent: Jun. 10, 1986

[54] INPUT ELEMENT WITH IMPROVED APPEARANCE AND RELIABILITY

[75] Inventors: Tetsuro Saito; Akihiko Komura, both of Hiratsuka, Japan

[73] Assignee: Canon Kabushiki Kaisha, Tokyo, Japan

[21] Appl. No.: 692,209

[22] Filed: Jan. 17, 1985

[30] Foreign Application Priority Data

Jan. 23, 1984 [JP] Japan ..... 59-9732
Jan. 24, 1984 [JP] Japan ..... 59-10644

[51] Int. Cl.[4] ..... H01H 13/02
[52] U.S. Cl. ..... 200/5 A; 200/159 B
[58] Field of Search ..... 200/5 A, 159 B, 308, 200/309, 310, 311, 312, 313, 314, 315, 316, 317, 86 R; 340/712, 365 P; 428/423.7

[56] References Cited

U.S. PATENT DOCUMENTS 4,010,311 3/1977 Lewis et al. ..... 428/423.7
4,423,299 12/1983 Gurol et al. ..... 200/159 B

*Primary Examiner*—A. D. Pellinen
*Assistant Examiner*—Morris Ginsburg
*Attorney, Agent, or Firm*—Fitzpatrick, Cella, Harper & Scinto

[57] ABSTRACT

An input element which comprises a pair of transparent substrates, of which at least one is flexible, each having electrodes of transparent electroconductive film on its surface, being arranged in confrontation with the surface provided with the electrodes facing each other with a space therebetween, and a first spacer being arranged at the peripheral portions of the pair of substrates to hold the space, wherein a reflective convex second spacers in dot are provided on the lower substrate all over the inside surface of the element.

7 Claims, 4 Drawing Figures

INPUT ELEMENT WITH IMPROVED APPEARANCE AND RELIABILITY

BACKGROUND OF THE INVENTION

1. Field of the Invention

This invention relates to an input element such as a panel switch having good outward appearance as well as high quality.

2. Description of the Prior Art

Panel switches have been used in recent years in combination with a display picture being output from a computer. For example, by superposing a panel switch on a display picture, when a certain letter, figure or pattern is touched with a finger tip, the touched portion is connected electrically, whereby the signal from an external circuit can be displayed on the display picture.

Such a panel switch is constituted of a pair of transparent substrates of which at least one is flexible, each having electrodes of transparent electroconductive film on its surface, and being arranged in confrontation with the electrode-carrying surfaces facing each other and with a space therebetween, and a spacer is arranged at the peripheral portions of said pair of substrates to hold said space, the respective film electrodes provided on one transparent substrate being connected to an external circuit. As the transparent substrate, glass or plastics have been employed, and as the transparent electroconductive film, indium oxide ($In_2O_3$) film, tin oxide ($SnO_2$) film (NESA film) or indium oxide film containing about 5 wt. % of tin oxide (ITO film) has been employed. When one surface of this panel switch is touched with a finger tip, the upper and lower electroconductive films at the touched portion are connected to each other, thereby informing the external circuit of the position touched by the finger tip.

In the panel switch of the prior art for prevention of malfunctioning caused by contact between a pair of electroconductive films while the switch is not actuated tension is applied on the upper substrate and such tension is received by the peripheral spacer and the adhesive. However, in such a panel switch, the upper substrate may be elongated due to changes in temperature or humidity to result in the diminished effect of the tension applied on the upper substrate, whereby contact may occur between the electroconductive films of the upper and lower substrates during its non-use.

SUMMARY OF THE INVENTION

An object of the present invention is to provide an input element such as panel switch which can function always correctly by preventing a contact between the electroconductive films of the upper and lower substrates during its non-use.

Such an object of the present invention can be accomplished by a panel switch (input element) which is provided with a convex reflective dot-like spacer (hereinafter referred to as "dot spacer") being unnoticeable in size and position according to the screen printing method, etc.

More specifically, according to the present invention, there is provided an input element, comprising a pair of transparent substrates, of which at least one is flexible, each having electrodes of transparent electroconductive film on its surface, being arranged in confrontation with the surface provided with the electrodes facing each other with a space therebetween, and a first spacer being arranged at the peripheral portions of said pair of substrates to hold said space, characterized in that reflective convex second spacers in dot form are provided on the lower substrate all over the inside surface of the element.

DESCRIPTION OF EMBODIMENTS OF THE INVENTION

Figure 1:
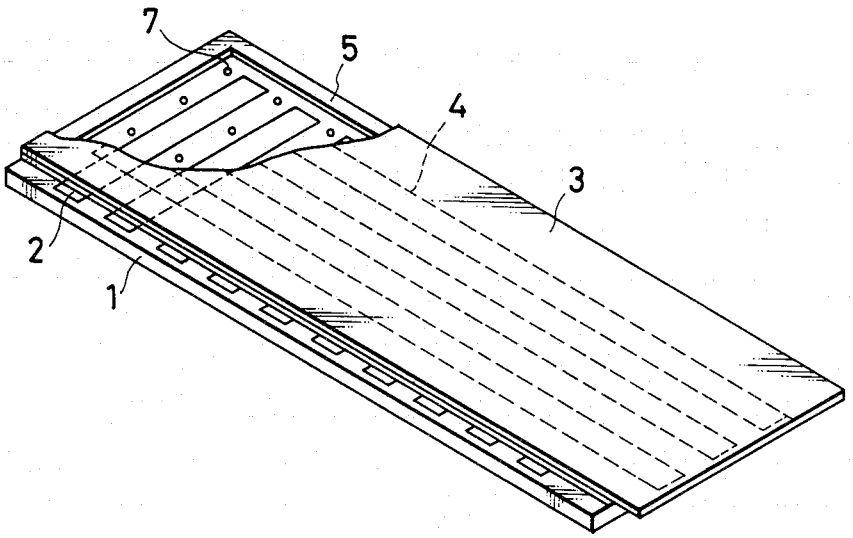
FIG. 1 and FIG. 2 are a perspective view and a sectional view, respectively, showing an embodiment of the panel switch according to the present invention.

It may be conceivable to provide dot spacers on both upper and lower substrates, only on the upper substrate or only on the lower substrate. A dot spacer should desirably be made of a material which is colorless and transparent so as to be unnoticeable. Since it is practically convenient to form a dot spacer by printing a liquid material on a substrate according to the screen printing method, followed by curing thereof, the tip end after curing of the material take a spherical form after curing, thus exhibiting a lens effect. Such a dot spacer should preferably be made to a height of from about $10\mu$ to $20\mu$. When a transparent dot spacer is provided on the lower substrate, the dot spacer has the effect of a convex mirror, it is not noticeable due to little brightening at the central portion although it may be more or less dark.

From the viewpoint as mentioned above, the present invention provides a panel switch, comprising a pair of transparent substrates, of which at least one is flexible, each having electrodes of transparent electroconductive film on its surface, being arranged in confrontation with the surface provided with the electrodes facing each other with a space therebetween, and a first spacer being arranged at the peripheral portions of said pair of substrates to hold said space, characterized in that a reflective convex second spacers in dot are provided on the lower substrate all over the inside surface of the switch.

Referring now to the drawings, the present invention is to be described in detail.

Figure 2:
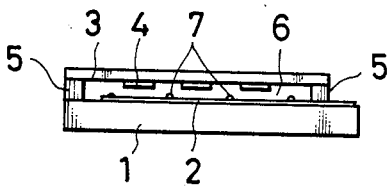

FIG. 1 and FIG. 2 show an embodiment of a panel switch according to the present invention, in which 1 denotes a lower substrate made of glass, 2 electrodes of ITO film subjected to patterning provided thereon, 3 an upper substrate made of PET (polyethylene terephthalate) film, 4 electrodes of ITO film subjected to patterning provided thereon, 5 a spacer arranged at the peripheral portion of a pair of these substrates and between both substrates. The above pair of substrates 1 and 3 confront each other with a space 6 therebetween with the electrodes 2, 4 made of ITO film arranged inside, and the space 6 (generally $50\mu$to to $200\mu$) is held by the spacer 5. These electrodes 2 and 4 constitute a matrix structure and, when the face of the substrate 3 is touched with a finger tip, the upper and lower electrodes 2 and 4 are connected to each other at the touched portion, thereby informing an external circuit of the position touched by the finger tip.

In the above panel switch, for prevention of contact between the electrodes 2 and 4 of the upper and lower substrates during its non-use, a dot-like spacer 7 is provided as the second spacer all over the inside surfaces of the pair of electrodes 1 and 3. The dot spacer is formed of a material which is colorless and transparent, and has a high refractive index. In practice, it is convenient to print the dot spacer 7 with a liquid material on a substrate according to the screen printing method, followed by curing thereof. Accordingly, the dot spacer becomes a spherical shape which functions as a lens after curing. As the material colorless and transparent, having a high refractive index to be used for this purpose, for example, there may preferably be employed a cured epoxy type adhesive.

Figure 3:
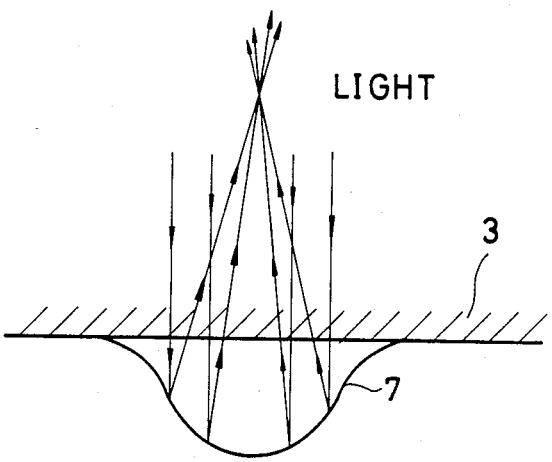
FIG. 3 (*a*) and (*b*) are schematic drawings for illustration of the function of the dot spacer.
Figure 3:
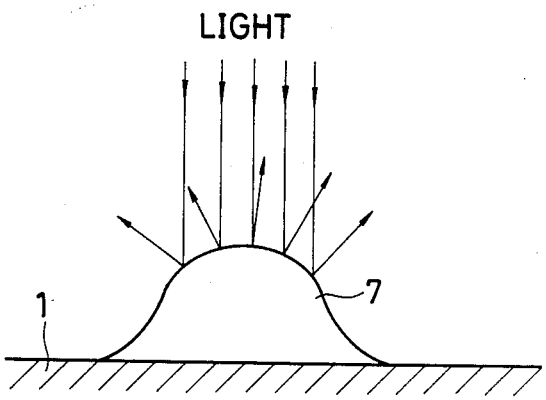

Such a dot spacer can be provided on both upper and lower substrates or on either one of them. However, if the dot spacer 7 is provided on the upper substrate 3 as shown in FIG. 3 (*a*), the dot spacer will function as a concave mirror, whereby the parallel light incident from above the upper substrate will be condensed as shown by the arrowhead to make brighter the central portion of the dot spacer and its peripheral portion darker. Under such a state, the presence of the dot spacer will become undesirably conspicuous for a panel switch.

According to the present invention, the above dot spacer is provided only on the lower substrate. As shown in FIG. 3 (*b*), when the dot spacer 7 is provided on the lower substrate 1, the parallel light incident from above the substrate will be scattered as shown by the arrowheads, whereby the portion at the dot spacer may become more or less dark and the portion at the dot spacer cannot become brighter to be conspicuous as in the case of FIG. 3 (*a*).

As described above, according to the present invention, contact between the electrodes of transparent electroconductive films provided on upper and lower substrates during its non-use can be prevented by the presence of the dot spacers, whereby the panel switch can be actuated always correctly, and provision of such a dot spacer only on the lower substrate makes it possible to give a panel switch with good appearance without impairing the function of the dot spacer itself.

If the dot spacer is excessively hard, it may sometimes damage the upper substrate, even resulting in noticeable deformation of the external portion in an extreme case. On the contrary, if it is excessively soft, it may ultimately be broken after being pushed repeatedly.

Now, as the result of extensive studies made by the present inventors, it has been found that a dot spacer endowed with both appropriate elasticity and durability against repeated load can be obtained by forming the dot spacer from a urethane type adhesive.

Thus, the panel switch of the present invention has a second specific feature that a large number of dot-like spacers are formed from a urethane type adhesive. The dot spacer 7 used in the panel switch as shown in FIG. 1 and FIG. 2 as described above can be formed of an urethane type adhesive to be endowed with both appropriate elasticity and durability against repeated load.

The panel switch according to the present invention is further illustrated by way of Examples.

EXAMPLE 1

As the lower substrate, a glass attached with ITO film is used and the ITO film is subjected to patterning with a printing resist to form electrodes. As the upper substrate, PET film IODTOR1 which is a PET film attached with ITO film produced by Teijin Co., Ltd., and its ITO film is subjected to patterning to form electrodes. A silicone type resin produced by Toray silicone, SE-1700 clear type, was provided in dots on the lower substrate according to screen printing, while keeping away from the electrodes of ITO film, followed by curing by heating. Then for the peripheral spacer and the epoxy adhesive, a mixture of Araldite AW 106/HV 953 U produced by Ciba-Geigy Co., Switzerland, mixed with plastic beads was used to constitute the panel switch. As the result, a panel switch of high quality with dot spacers which are not noticeable was obtained.

EXAMPLE 2

As the lower substrate, a 1.1 mm glass plate coated with ITO film ($In_2O_3/SnO_2$) was employed, and after the coating of ITO was made to have a resistance value of 300 Ω/□ an etching resist was printed according to screen printing. After resist curing, etching was performed to effect patterning of the ITO film. After the resist was peeled off, dot spacers were formed by screen printing of the glass surface, while keeping away from the contact points of ITO. For the dot spacers, a mixture of urethane type adhesive Adeka Hontiter (trade name) A/BM-2 produced by Asahi Denka Kogyo Co., Ltd. were employed at a weight ratio of (A):(BM-2)=100:3.5, and after printing, the spacers were superheated at 120° C. for 40 minutes. As the upper substrate, a film attached with ITO film IODTOR1 produced by Teijin Co., Ltd. was employed, and an etching resist was printed thereon, followed by curing and patterning to prepare a pattern in stripes. The upper substrate was arranged in such a manner that the pattern thereon is directed orthogonal to that on the lower substrate previously prepared, followed by adhesion at the peripheral portions of both substrates with an epoxy type adhesive Araldite AW106/HV953U, to constitute a panel switch. This panel switch was tested by striking with a plunger. The function of the spacer was maintained even after striking repeatedly for 50,000 times, and no abnormal symptom was observed on the film of the upper substrate.

COMPARATIVE EXAMPLE 1

A panel switch was prepared with entirely the same constitution as the above Examples according to the same procedure as in Example 2 except for using an epoxy type adhesive Araldite AW106/HV953U as the material for the dot spacers. The spacers of this panel switch were broken after the striking test repeated 800 times to lose the function of a spacer.

What is claimed is:

1. A panel switch, comprising a pair of transparent substrates one of which is flexible and comprises a flexible film and the other of which comprises a glass plate, each having electrodes of transparent electroconductive film on one surface, being arranged in confrontation with each other in such a manner that the surfaces provided with the electrodes face each other with a space therebetween, and a first spacer arranged at the peripheral portions of said pair of substrates to maintain said space, and reflective convex second spacers provided in dot form all over said one surface of said glass plate except for where the transparent electroconductive film is formed.

2. A panel switch according to claim 1, wherein the second spacers are formed of a resin having a high refractive index.

3. A panel switch according to claim 2, wherein said resin with a high refractive index is a silicone resin.

4. A panel switch according to claim 1, wherein said second spacers are formed to a height of from 10 to 20μ.

5. A panel switch according to claim 1, wherein said space is formed to define an electrode distance of from 50μ to 200μ.

6. A panel switch according to claim 1, wherein said flexible substrate is a polyethylene terephthalate film.

7. A panel switch according to claim 1, wherein said second spacers are formed from a urethane type adhesive.

* * * * *

UNITED STATES PATENT AND TRADEMARK OFFICE

CERTIFICATE OF CORRECTION

PATENT NO. : 4,594,482

DATED : June 10, 1986

INVENTOR(S) : TETSURO SAITO, ET AL.

It is certified that error appears in the above-identified patent and that said Letters Patent is hereby corrected as shown below:

Column 1, line 37, change "art" to --art,--;

line 39, change "actuated" to --actuated,--.

Column 2, line 23, change "take" to --takes--.

Signed and Sealed this

Twenty-fourth Day of March, 1987

*Attest:*

DONALD J. QUIGG

*Attesting Officer* *Commissioner of Patents and Trademarks*